US008166598B2

(12) United States Patent
Steedley

(10) Patent No.: US 8,166,598 B2
(45) Date of Patent: May 1, 2012

(54) ELONGATED, U-SHAPED, BIASED CLEANING APPARATUS WITH HANDLE ALIGNED WITH CLEANING HEAD

(76) Inventor: Gerald Craig Steedley, Jacksonville, FL (US)

( * ) Notice: Subject to any disclaimer, the term of this patent is extended or adjusted under 35 U.S.C. 154(b) by 853 days.

(21) Appl. No.: 12/261,036

(22) Filed: Oct. 30, 2008

(65) Prior Publication Data

US 2010/0107348 A1 May 6, 2010

(51) Int. Cl.
*A46B 5/02* (2006.01)

(52) U.S. Cl. ..... 15/144.1; 15/145

(58) Field of Classification Search ..... 15/144.1, 15/143.1, 145

See application file for complete search history.

(56) References Cited

U.S. PATENT DOCUMENTS 4,425,161 A * 1/1984 Shibahashi et al. ..... 106/31.17
5,528,792 A * 6/1996 Nazemi ..... 15/160
5,530,983 A * 7/1996 Maltese ..... 15/160
5,671,497 A * 9/1997 Abdo ..... 15/144.1
D389,319 S * 1/1998 Gelinas ..... D4/132
D396,328 S * 7/1998 Jarvis ..... D28/7
6,704,967 B2 * 3/2004 Gianelli et al. ..... 16/422

FOREIGN PATENT DOCUMENTS

DE 2433140 * 1/1975

OTHER PUBLICATIONS

Computer generated English translation of DE 2433140, Jan. 1975, Halg.*

* cited by examiner

*Primary Examiner* — Laura C Guidotti
(74) *Attorney, Agent, or Firm* — Mark Young, P.A.

(57) ABSTRACT

A cleaning device includes an elongated u-shaped handle terminating with a mounting neck at a distal end. A handgrip engages the handle at the proximal end. A support strap may attached to the handgrip. A cleaning head is releasably attached to the mounting neck. The cleaning head is configured to releasably engage the mounting neck. The handle is u-shaped and resilient to generate a biasing force that facilitates use and cleaning contact. The cleaning head is opposite and in direct alignment with the handgrip, so that a user may determine the exact position of the cleaning head against the user's back by observing the position of the handgrip.

9 Claims, 2 Drawing Sheets

ELONGATED, U-SHAPED, BIASED CLEANING APPARATUS WITH HANDLE ALIGNED WITH CLEANING HEAD

FIELD OF THE INVENTION

This invention generally relates to cleaning devices, and more particularly, to an elongated, u-shaped cleaning device with an easy-to-replace, removable, disposable, cleaning head, and non-slip ergonomic handles.

BACKGROUND

Various elongated cleaning devices have been devised to apply soaps, lotions, and other cleaners and cosmetic preparations to areas that are normally inaccessible or difficult to reach using one's own hands. For example, portions of the back of a person are normally difficult to reach. Disabled individuals may be unable to reach one side or another, much less their back. Thus, an elongated device may be used to assist cleaning.

Conventional cleaning devices include a sponge or brush affixed to a handle. In each instance, the installation and removal process is quite complex and conducive to error. In many instances, releasable attachments lack sufficient integrity, making the pads susceptible to unintended release. In many other instances, the attachment is permanent.

Due to the aforementioned problems, conventional extended cleaning devices have not succeeded in the marketplace. What is needed is a reliable cleaning device that is easy-to-use, configure and maintain and well suited for hygienic, dermatological, cosmetic, therapeutic and other uses. The invention is directed to overcoming one or more of the problems and solving one or more of the needs as set forth above.

SUMMARY OF THE INVENTION

To solve one or more of the problems set forth above, in an exemplary implementation of the invention, a cleaning head is provided. The assembly includes an elongated u-shaped handle terminating with a mounting neck at a distal end. A hand grip engages the handle at the opposite proximal end. A support strap may be attached to the handgrip. A cleaning head is releasably attached to the mounting neck. The cleaning head is configured to releasably engage the mounting neck. The cleaning head provides a reliable cleaning device that is easy-to-use, configure and maintain.

In one exemplary embodiment, a cleaning device includes a resilient body having a proximal section with a free end and an opposite end connected to a bight section at a first end of the bight section, and a distal section with a free end and an opposite end connected to the bight section at a second end of the bight section, and a cleaning head attached to the free end of the distal section. The cleaning head is aligned with and opposite the proximal section, such that the position of the free end of the proximal section defines the relative position of the cleaning head. The bight section comprises a bend of at least one 180 degrees or greater. The cleaning head may be releasably attached to the free end of the distal section. A handgrip may be attached to the free end of the proximal section. The length of the distal section is about equal to the length of the proximal section. The resilient body may be integrally formed.

In another exemplary embodiment, a cleaning device includes an elongated curved body having a proximal segment, a distal segment, an intermediate segment, and a mounting neck attached at the distal segment. The proximal segment has a free end and an end attached to a proximal end of the intermediate segment. The distal segment has a first end attached to the mounting neck and a second end attached to a distal end of the intermediate segment. A cleaning head is attached to the mounting neck. The cleaning head is aligned with and opposite the proximal segment, such that the position of the free end of the proximal segment defines the relative position of the cleaning head. The intermediate segment is a bight having a radius of curvature of at least three inches (preferably about three to eight inches) and an angle of curvature of at least 120 degrees, preferably between 120 and 300 degrees. The elongated curved body is shaped to provide a vertical space between the proximal segment and the distal segment. The space is capable of is widened by urging the distal and proximal segments apart from each other. The space is capable of is widened by urging the distal and proximal segments apart from each other and sufficient to allow room for a human torso when widened. The elongated curved body is resiliently biased such that the distal and proximal segments are biased towards one another when urged apart. The biasing is sufficient to maintain good cleaning contact of the cleaning head against a body by exerting a pressure of between 1 psi and 15 psi against any object such as a torso between the proximal and distal segments. The cleaning head may be removably attached to the mounting neck. The cleaning head may comprise netting, a sponge, a brush with bristles, or a luffa. The elongated curved body is formulated to change color when its temperature reaches at least 110 degrees Fahrenheit. The elongated curved body may be formulated with a phosphorescent polymer additive so that it glows in the dark.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, shapes, relative sizes, ornamental aspects or proportions shown in the figures.

DETAILED DESCRIPTION

Figure 1:
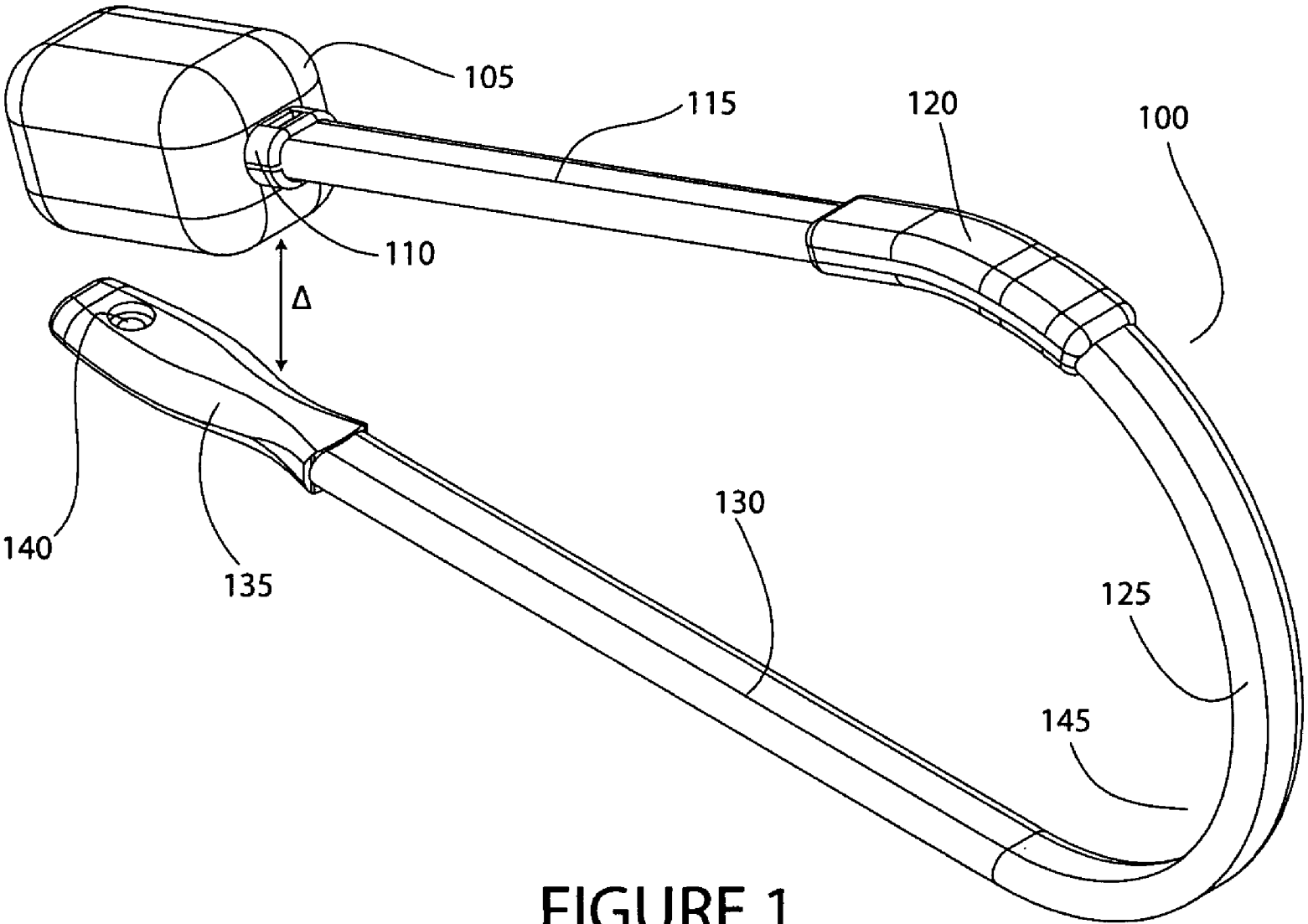
FIG. 1 shows a perspective view of an exemplary assembled cleaning device according to principles of the invention.
Figure 2:
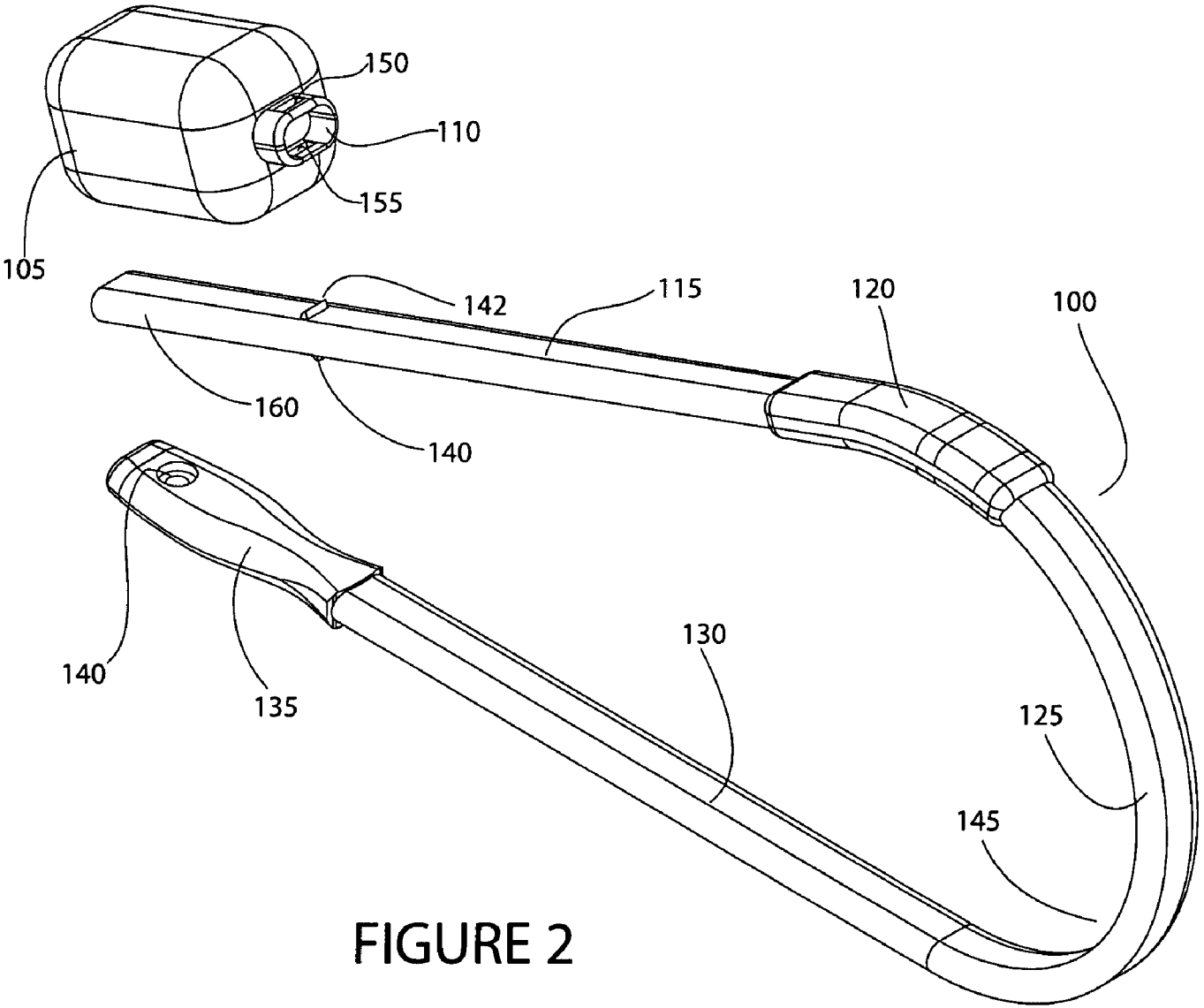
FIG. 2 shows an exploded perspective view of an exemplary assembled cleaning device according to principles of the invention.

Referring to the Figures, in which like parts are indicated with the same reference numerals, various views of an exemplary cleaning device according to principles of the invention are shown. As shown in FIGS. 1 and 2, an exemplary cleaning device 100 according to principles of the invention comprises an elongated u-shaped handle 145 terminating in a mounting neck 160 at the distal (cleaning) end and engaged by a hand grip 135 at the opposite proximal (handheld) end. A support strap may optionally be attached through a hole 140 in the hand grip 135. A cleaning head 105 is attached to the mounting neck 160. Preferably, the cleaning head 105 releasably engages the mounting neck 160. However, a permanently attached cleaning head 105 also comes within the scope of the invention.

The hand grip 135 features a size, contour and ergonomic configuration to comfortably fit a hand. The hand grip 135 is preferably fabricated of a padding material such as a closed cell foam (e.g., Neoprene foam) or other cushioning material. In one embodiment, the hand grip 135 provides sufficient buoyancy to prevent the cleaning device 100 from sinking in a bathtub full of water.

Optionally, an intermediate hand grip 120 is provided to further facilitate handling, especially when the device is being used to clean one's front side. Thus, advantageously, in one embodiment, the cleaning device includes two handling means, one for back scrubbing 135 and another to facilitate front scrubbing 120.

The handle 145 includes a proximal segment 130, a distal segment 115, an intermediate segment 125, and a mounting neck 160 attached at the distal segment 115. The proximal segment 130 of the handle 145 is configured to mate with the hand grip 135. The mounting neck 160 is configured to releasably engage the cleaning head 105. The intermediate segment is a curved section, such as a curve having a radius of curvature between 3 and 8 inches and an angle of curvature of between 120 and 300 degrees. As used herein, the term "u-shaped" is used to describe any arrangement in which the distal and proximal segments 115, 130 are parallel or in an acute angular relationship, and the intermediate section is as described above. The distal segment 115 and neck 160 is approximately the same length as the proximal segment 130, such that the hand grip 135 and cleaning head 105 are approximately in opposed position (i.e., occupying opposite terminal ends of the u-shaped handle 145). This relationship facilitates handling, because a person using the device to clean his or her back will know that the cleaning head 105 is exactly directly behind the handle 135. Even users with physical conditions that prevent tactile sensation of the cleaning head 105 against their back can determine where the cleaning head 105 by observing the position and orientation of the handgrip 135. Thus, the handgrip 135 serves as a marker or position indicator for the opposed cleaning head 105. The cleaning device may be configured to accommodate people of all sizes, including children and adults.

The exemplary handle 145 is resilient and shaped to provide a vertical space Δ between the proximal segment 130 of the handle and the distal segment 115. The space Δ may be widened by urging the distal and proximal segments apart from each other to allow room for a human torso. The handle 145 is resiliently biased so that the spread apart distal and proximal segments are urged towards one another. The biasing force is sufficient to maintain good cleaning contact of the cleaning head 105 against the body, but not so great as to cause any discomfort. The biasing force may exert sufficient pressure (e.g., 1 to 15 psi) to facilitate safe, effective and comfortable cleaning of a body surface. The exerted pressure may vary depending upon the handle 145 configuration, composition and method of manufacture, as well as the amount by which the distal and proximal segments are spread apart. By exerting pressure, the handle 145 avoids the need of a user to independently exert and maintain cleaning force, making the device particularly well suited for aged, infirm and physically challenged individuals.

The handle 145 may be solid or hollow in construction. In a preferred embodiment, the handle 145 is comprised of a plastic or polymeric material, such as polyvinyl chloride (PVC), polyethylene, polypropylene, polystyrene, acrylics, cellulosics, acrylonitrile-butadiene-styrene (ABS) terpolymers, urethanes, thermo-plastic resins, thermo-plastic elastomers (TPE), acetal resins, polyamides, polycarbonates and polyesters. While many other materials may be used alone or in combination with the aforementioned materials and/or other materials, without departing from the scope of the present invention, preferably the material is relatively inexpensive, easy to use in manufacturing operations and results in an aesthetically acceptable, durable, weather resistant product. The material may further include additives to provide desired properties such as desired colors, structural characteristics, glow-in-the dark properties and thermal reactivity (e.g., color changes according to heat).

By way of example and not limitation, a plastic handle 145 may optionally be formulated to change color when it reaches a predetermined or higher temperature. This can be accomplished by mixing a thermochromic additive to the base material in an amount that is sufficient to achieve a desired color changing range (i.e., an effective amount). As an example, a mixture of approximately 5% to 30% (pbw) of Matsui International Co., Inc.'s Chromicolor® concentrate may be introduced to plastic base material, to provide a plastic structure that visibly changes color at a determined elevated temperature, such as approximately 110 degrees Fahrenheit or higher. Such a color change may provide a scalding warning to a bather. Thus, in one embodiment, the cleaning device 100 provides a visible indication of safe bathing temperature.

As another alternative, phosphorescent polymer additives, such as aluminate based phosphors, may be added in an amount sufficient to adsorb light energy and continue to release that energy as visible light after the energy source is removed (i.e., an effective amount). Advantageously, such an embodiment provides a device that glows in the dark and is easy to locate in darkened conditions, making the device easy to spot even in an unlit room. Such a handle 145 may facilitate finding the cleaning device 100 in darkened conditions.

The handle 145 is preferably sufficiently strong and water resistant such that it does not structurally fail from the stresses and environmental conditions encountered during use. Within these parameters, the handle 145 may be formulated to exhibit flexibility and resiliency such that the handle 145 can flex in response to forces normally applied during bathing and return to its original shape without appreciable permanent deformation during normal use.

An exemplary cleaning head 105 according to principles of the invention may comprise netting commonly used for shower brushes, a sponge, a brush with bristles, a luffa (i.e., a loofa) or some other device. Accessories such as a back scratcher and mirror may also be attached. Thus, in one embodiment, the cleaning device 100 provides a plurality of interchangeable cleaning and grooming heads.

The exemplary cleaning head 105 also includes means for attaching to the mounting neck 160. In the exemplary embodiment shown in FIG. 2, a collar 110 is configured to receive and securely but releasably engage the mounting neck 160 of the handle 145. A pair of resilient catches or tabs 140, 142 on the mounting neck 160 are configured to releasably mate with corresponding slots 150, 155 in the collar 110. The catches 140, 142 may be depressed to allow the mounting neck 160 to slide into the mounting collar 110. When the mounting neck 160 is fully received in the collar 110, the resilient catches 140, 142 spring back to their original position, thereby mating with the corresponding slots 150, 155 and releasably locking the mounting neck 160 into place.

Components of the cleaning device 100 may be produced using any suitable manufacturing techniques known in the art for the chosen material, such as (for example) milling, casting, stamping and machining, and injection, compression, structural foam, blow, or transfer molding; polyurethane foam processing techniques; vacuum forming; and casting. Preferably, the manufacturing technique is suitable for mass production at relatively low cost per unit, and results in an aesthetically acceptable product with a consistent acceptable quality.

By way of illustration and not limitation, in one exemplary embodiment, a cleaning device according to principles of the invention includes a resilient body having a proximal section with a free end and an opposite end connected to a bight section at a first end of the bight section, and a distal section with a free end and an opposite end connected to the bight section at a second end of the bight section, and a cleaning head attached to the free end of the distal section. The cleaning head is aligned with and opposite the proximal section, such that the position of the free end of the proximal section defines the relative position of the cleaning head. The bight section comprises a bend of at least one 180 degrees or greater. The cleaning head may be releasably attached to the free end of the distal section. A handgrip may be attached to the free end of the proximal section. The length of the distal section is about equal to the length of the proximal section. The resilient body may be integrally formed.

In another exemplary embodiment, a cleaning device according to principles of the invention includes an elongated curved body having a proximal segment, a distal segment, an intermediate segment, and a mounting neck attached at the distal segment. The proximal segment has a free end and an end attached to a proximal end of the intermediate segment. The distal segment has a first end attached to the mounting neck and a second end attached to a distal end of the intermediate segment. A cleaning head is attached to the mounting neck. The cleaning head is aligned with and opposite the proximal segment, such that the position of the free end of the proximal segment defines the relative position of the cleaning head. The intermediate segment is a bight having a radius of curvature of at least three inches (preferably about three to eight inches to accommodate children and adults of various sizes and physiques) and an angle of curvature of at least 120 degrees, preferably between 120 and 300 degrees. The elongated curved body is shaped to provide a vertical space between the proximal segment and the distal segment. The space is capable of being widened by urging the distal and proximal segments apart from each other. The space is capable of is widened by urging the distal and proximal segments apart from each other and sufficient to allow room for a human torso when widened. The elongated curved body is resiliently biased such that the distal and proximal segments are biased towards one another when urged apart. The biasing is sufficient to maintain good cleaning contact of the cleaning head against a body by exerting a pressure of between 1 psi and 15 psi against any object such as a torso between the proximal and distal segments. The cleaning head may be removably attached to the mounting neck. The cleaning head may comprise netting, a sponge, a brush with bristles, or a luffa. The elongated curved body is formulated to change color when its temperature reaches at least 110 degrees Fahrenheit. The elongated curved body may be formulated with a phosphorescent polymer additive so that it glows in the dark.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A cleaning device comprising an elongated curved body having a proximal segment, a distal segment, an intermediate segment, and a mounting neck attached at the distal segment, said proximal segment having a free end and an end attached to a proximal end of the intermediate segment, and said distal segment having a first end attached to said mounting neck and a second end attached to a distal end of the intermediate segment, and a cleaning head attached to the mounting neck, said cleaning head being aligned with and opposite said proximal segment, such that the position of the free end of the proximal segment defines the relative position of the cleaning head, said intermediate segment being a bight having a radius of curvature of at least three inches and an angle of curvature of at least 120 degrees, wherein said elongated curved body is shaped to provide a vertical space between the proximal segment and the distal segment, said space being capable of being widened by urging the distal and proximal segments apart from each other and said elongated curved body being resiliently biased such that the distal and proximal segments are biased towards one another when urged apart.

2. A cleaning device according to claim 1, wherein said radius of curvature is between three to eight inches.

3. A cleaning device according to claim 1, wherein said angle of curvature is between 120 and 300 degrees.

4. A cleaning device according to claim 1, wherein said biasing be sufficient to maintain good cleaning contact of the cleaning head against a body.

5. A cleaning device according to claim 1, wherein said biasing causing the cleaning head to exert a pressure of between 1 psi and 15 psi against any torso between the proximal and distal segments.

6. A cleaning device according to claim 1, wherein said cleaning head is removably attached to said mounting neck.

7. A cleaning device according to claim 1, wherein said cleaning head comprises a cleaning structure from the group consisting of netting, a sponge, a brush with bristles, and a luffa.

8. A cleaning device according to claim 1, wherein the elongated curved body is formulated to change color when its temperature reaches at least 110 degrees Fahrenheit.

9. A cleaning device according to claim 1, wherein the elongated curved body is formulated with a phosphorescent polymer additive.

* * * * *